US005919514A

United States Patent [19]

Orlowski et al.

[11] Patent Number: 5,919,514

[45] Date of Patent: Jul. 6, 1999

[54] PROCESS FOR PREPARING ELECTRODED DONOR ROLLS

[75] Inventors: Thomas E. Orlowski, Fairport; Donald S. Sypula; Joseph Mammino, both of Penfield; John W. Spiewak; Raymond E. Bailey, both of Webster, all of N.Y.

[73] Assignee: Xerox Corporation, Stamford, Conn.

[21] Appl. No.: 07/997,489

[22] Filed: Dec. 28, 1992

[51] Int. Cl.[6] ..... B05D 5/12

[52] U.S. Cl. ..... 427/123; 427/125; 427/264; 427/98

[58] Field of Search ..... 427/123, 125, 427/264, 98

[56] References Cited

U.S. PATENT DOCUMENTS

| | | | |
|---|---|---|---|
| 3,347,724 | 10/1967 | Schneble, Jr. et al. | 156/151 |
| 3,610,143 | 10/1971 | Greenwood et al. | 101/128.2 |
| 3,632,435 | 1/1972 | Segeltorp et al. | 117/212 |
| 3,839,083 | 10/1974 | Shivonen et al. | 117/212 |
| 3,996,892 | 12/1976 | Parker et al. | 118/658 |
| 3,997,472 | 12/1976 | O'Driscoll et al. | 252/430 |
| 4,001,466 | 1/1977 | Shaul et al. | 427/96 |
| 4,006,047 | 2/1977 | Brummett et al. | 156/656 |
| 4,098,922 | 7/1978 | Dinella et al. | 427/54 |
| 4,107,351 | 8/1978 | James et al. | 427/43 |
| 4,143,253 | 3/1979 | Wagner et al. | 200/5 A |
| 4,252,676 | 2/1981 | Smith | 252/430 |
| 4,252,677 | 2/1981 | Smith | 252/430 |
| 4,568,955 | 2/1986 | Hosoya et al. | 346/153.1 |
| 4,666,735 | 5/1987 | Hoover | 427/43.1 |
| 4,718,972 | 1/1988 | Babu et al. | 427/98 |
| 4,865,873 | 9/1989 | Cole, Jr. et al. | 427/98 |
| 4,868,600 | 9/1989 | Hays et al. | 355/259 |
| 4,876,177 | 10/1989 | Akahoshi et al. | 427/98 |
| 4,888,209 | 12/1989 | Neely | 427/97 |
| 4,915,983 | 4/1990 | Lake et al. | 427/98 |
| 5,137,618 | 8/1992 | Burnett et al. | 427/98 |
| 5,141,829 | 8/1992 | Dumas et al. | 430/5 |
| 5,153,023 | 10/1992 | Orlowski et al. | 427/555 |
| 5,171,608 | 12/1992 | Greene et al. | 427/98 |

*Primary Examiner*—Walter D. Griffin
*Attorney, Agent, or Firm*—Zosan S. Soong

[57] ABSTRACT

A process for preparing a toner donor roll having an integral electrode pattern involving: (a) providing a cylindrically shaped insulating member; (b) coating the insulating member with a photo or thermally sensitive composition comprised of a polymeric material and a conductive metal nucleating agent; (c) patterning the composition, resulting in a first composition portion corresponding to the electrode pattern and a second composition portion; and (d) depositing conductive metal on the first composition portion, resulting in the electrode pattern which is capable of being electrically biased to detach toner particles from the donor roll. In an alternative embodiment, there is provided an insulating member comprised of an insulating polymeric material and a conductive metal nucleating agent.

24 Claims, 1 Drawing Sheet

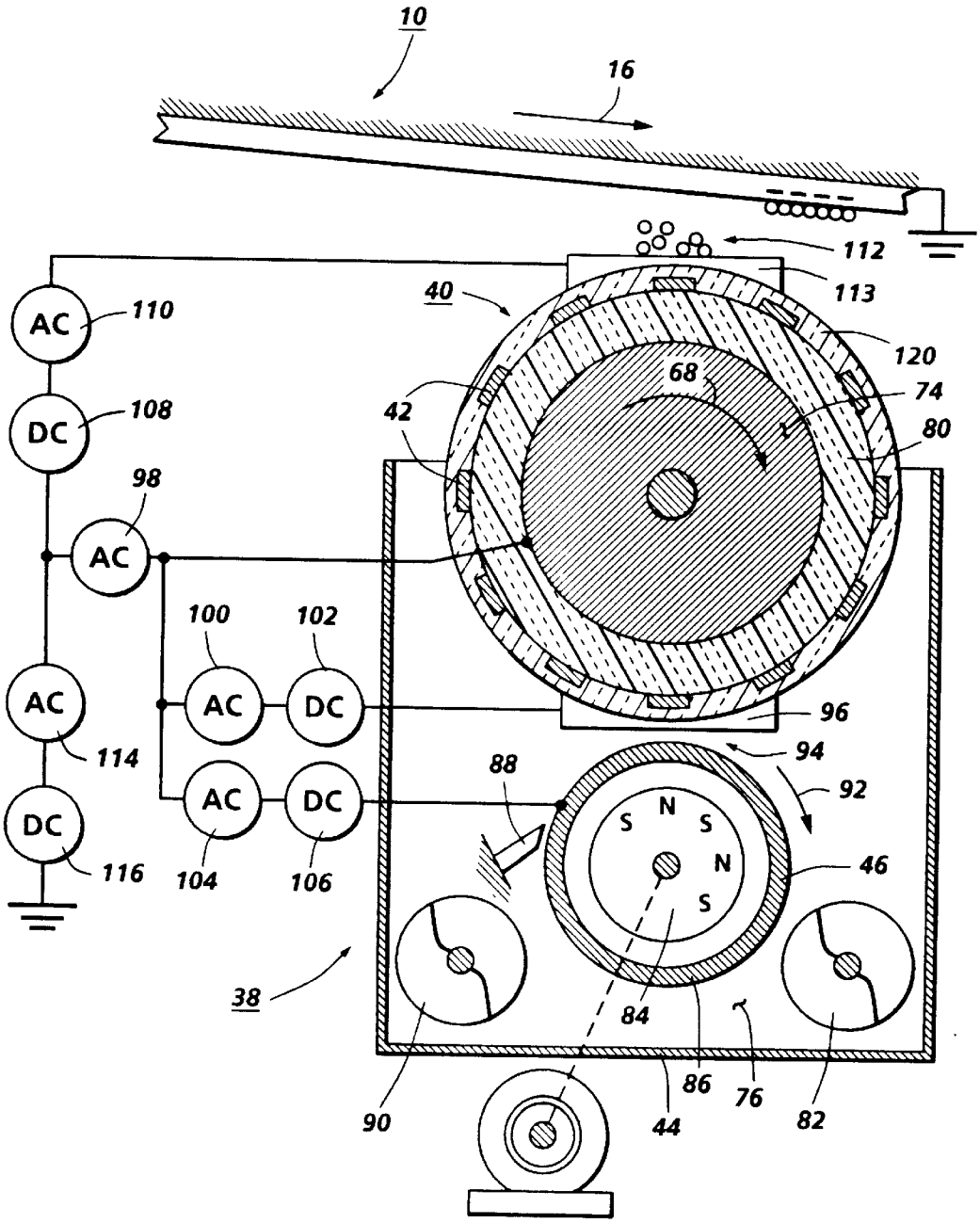
10
16
112
113
40
120
68
74
42
80
AC
110
DC
108
98
AC
100
102
AC
DC
96
AC
114
94
88
92
DC
116
AC
DC
104
106
N
S
S
N
S
46
38
84
86
76
90
44
82

PROCESS FOR PREPARING ELECTRODED DONOR ROLLS

This invention relates generally to a process for preparing an electroded donor roll or donor rolls, and particularly concerns fabrication of a donor roll having an integral electrode pattern on the surface thereof wherein the electrode pattern is formed in embodiments using a radiation sensitive composition containing a nucleating agent. The phrase radiation sensitive composition includes photo and thermally sensitive materials, especially polymeric materials that crosslink or degrade in response to light or heat. The donor rolls prepared can be selected for use in electrophotographic printing or copying apparatuses.

Generally, the process of electrophotographic printing and copying includes charging a photoconductive member to a substantially uniform potential so as to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two-component and single-component developer materials are commonly used. A typical two-component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development unit employs a magnetic brush developer roller for transporting carrier having toner particles adhering triboelectrically thereto. The donor roll and magnetic roll are electrically biased relative to one another. Toner is attracted to the donor roll from the magnetic roll. The electrically biased electrode wires detach the toner from the donor roll forming a toner powder cloud in the development zone. The latent image attracts the toner particles thereto from the toner powder cloud. In this way, the latent image recorded on the photoconductive member is developed with toner particles. It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

Various photolithographic processes to deposit conductive metal on a substrate are known as illustrated by the following:

Schneble et al., U.S. Pat. No. 3,347,724, discloses a process for producing metallized flexible and foraminous insulating material which comprises impregnating the material with a resinous adhesive having dispersed therein an agent catalytic to the reception of electroless metal, masking a portion of the surface of the impregnated material to leave exposed surface areas, and depositing ductile metal on the exposed surface areas by contacting the impregnated and masked material with an aqueous autocatalytic metal depositing solution capable of electrolessly depositing ductile metal on such areas. Reference is made, for example, to Col. 3, lines 45–64.

Neely, U.S. Pat. No. 4,888,209, discloses a process for depositing a monolayer of positively charged soluble or insoluble polymers containing an active agent distributed throughout the polymers, where the insoluble polymer particles containing the active agent have particle size diameters less than about three micrometers, on a surface, and contacting the deposited monolayer with one or more suitable reactants to conduct or catalyze a reaction on the surface.

Orlowski et al., U.S. Pat. No. 5,153,023, discloses a method of forming at least one electrically conductive path in a plastic substrate comprising providing a thermoplastic substrate having a melting point below 325° C., coating said substrate with a precursor of a catalyst for the electroless deposition of conductive metals, said catalyst precursor having a decomposition temperature below the melting point of said thermoplastic and within the temperature range where said thermoplastic softens, heating the portion of said coated thermoplastic substrate corresponding to said conductive path to a temperature sufficient to decompose said catalyst precursor to said catalyst and soften said thermoplastic; said substrate, catalyst precursor and temperature being selected such that on heating to the temperature the precursor decomposes to the catalyst, the thermoplastic softens and at least partially melts without substantial decomposition to enable the catalyst to penetrate the surface of the thermoplastic and become anchored thereto to provide nucleation sites for the subsequent electroless deposition of conductive metal and depositing conductive metal by electroless deposition on said heated portion to form said conductive path. The substrate containing the electrically conductive path may be a planar member, a two-sided circuit board, or a frame or structural member in a machine such as automatic reprographic machines, including office copiers, duplicators and printers.

Other processes to deposit conductive metal on a substrate and various latent image development apparatuses are known as illustrated by the following: Hoover et al., U.S. Pat. No. 4,666,735; Segeltorp et al., U.S. Pat. No. 3,632,435; James et al., U.S. Pat. No. 4,107,351; Wagner et al., U.S. Pat. No. 4,143,253; Lake et al., U.S. Pat. No. 4,915,983; Hosoya et al., U.S. Pat. No. 4,568,955; Parker et al., U.S. Pat. No. 3,996,892; Brummett et al., U.S. Pat. No. 4,006,047; Sihvonen et al., U.S. Pat. No. 3,839,083; Hays et al., U.S. Pat. No. 4,868,600; Greenwood et al., U.S. Pat. No. 3,610,143; Shaul et al., U.S. Pat. No. 4,001,466; Dinella et al., U.S. Pat. No. 4,098,922; Dumas et al., U.S. Pat. No. 5,141,829; O'Driscoll et al., U.S. Pat. No. 3,997,472; Smith, U.S. Pat. No. 4,252,676; Smith, U.S. Pat. No. 4,252,677; and Japanese Patent Document 1-99074.

In copending Sypula, U.S. application Ser. No. 07/961,770, filed Oct. 16, 1992 (Attorney Docket No. D/92286), now U.S. Pat. No. 5,268,259, the disclosure of which is totally incorporated by reference, there is disclosed a process for preparing a donor roll having an electrode pattern comprising: (a) providing a cylindrically shaped insulating member; (b) coating the insulating member with a light sensitive photoresist; (c) patterning the photoresist by exposure to light, resulting in a first photoresist portion corresponding to the electrode pattern and a second photoresist portion; (d) removing the first photoresist portion, thereby exposing a portion of the insulating member; and (e) depositing conductive metal on the portion of the insulating member where the first photoresist portion has been removed, resulting in the electrode pattern which is capable of being electrically biased to detach toner particles from the donor roll.

In copending Hays et al., U.S. application Ser. No. 07/851,411, filed Mar. 13, 1992 (Attorney Docket No. D/91730), now U.S. Pat. No. 5,172,170, there is disclosed an apparatus for developing a latent image recorded on a surface, including: (1) a housing defining a chamber storing at least a supply of toner therein; (2) a moving donor member spaced from the surface and adapted to transport toner from the chamber of said housing to a development zone adjacent the surface; and (3) an electrode member integral with said donor member and adapted to move therewith, said electrode member being electrically biased to detach toner from said donor member to form a cloud of toner in the space between said electrode member and the surface with toner developing the latent image.

In copending Hays, U.S. application Ser. No. 07/724,242, filed Jul. 1, 1991 (Attorney Docket No. D/86305Q), now abandoned, there is disclosed an apparatus for forming images on a photoconductive surface with toner, said apparatus comprising: a donor member having toner particles thereon; two sets of electrodes arranged such that the electrodes of one of said two sets is interdigited with the other of said two sets; means for applying a DC bias to both sets of electrodes; means for applying an AC bias to at least one of said two sets of electrodes; said AC and DC biases having predetermined magnitudes and being applied in a manner such that AC electrostatic fields are established between adjacent electrodes without DC fields being created therebetween for liberating toner on said donor member for developing toner images on said photoconductive surface without developing background areas.

SUMMARY OF THE INVENTION

It is an object of the present invention to prepare an electroded donor roll by photo or thermal radiation.

It is an additional object to provide donor rolls and processes for the fabrication thereof.

It is another object to prepare an electrode structure integral with the donor roll.

It is a further object to prepare a donor roll having an electrode structure which is capable of being electrically biased to detach toner from the donor roll to form a cloud of toner for development of a latent image.

It is an additional object to provide devices for electrically biasing the electrode structure to detach toner from the donor roll to form a cloud of toner for development of a latent image.

Still another object is to form an electrode pattern on a donor roll by electroless metal deposition.

These objects and others can be accomplished in embodiments by a process for preparing a donor roll having an electrode pattern comprising:

(a) providing a cylindrically shaped insulating member;

(b) coating the insulating member with a photo or thermally sensitive composition comprised of a polymeric material and a conductive metal nucleating agent;

(c) patterning the composition, resulting in a first composition portion corresponding to the electrode pattern and a second composition portion; and (d) depositing conductive metal on the first composition portion, resulting in the electrode pattern which is capable of being electrically biased to enable for example the detachment of toner particles from the donor roll.

BRIEF DESCRIPTION OF THE DRAWINGS

Other aspects of the present invention will become apparent from the following description and upon reference to the FIGURE which is a schematic elevational view showing a representative development apparatus of an electrophotographic printer/copier device.

DETAILED DESCRIPTION

There is provided a cylindrically shaped insulating member. The insulating member may be of any suitable effective length and diameter, preferably of a length of from about 12 to about 16 inches and of a diameter of from about 0.75 to about 1.25 inches, and more preferably of a length of about 13.130 inches and a diameter of about 0.983 inch. In embodiments, the insulating member may be entirely comprised of an insulating material. Preferably, the insulating member is comprised of a metal core overcoated by a layer of insulating material. The metal core may be any suitable metal including nickel, aluminum, steel, iron, copper, and the like, and mixtures thereof. The insulating material may be any suitable dielectric substance including polymeric compositions comprised of polyamide-imide such as Amoco Torlon AI-10 and Torlon 4203L, both available from Amoco Company, polyurethane, polyamide, polycarbonate, polyester, polyetherimide, polyimide, polynitrocellulose, polyolefins such as polyethylene, polypropylene, poly (ethylenevinylacetate), poly-2-pentene, terpolymer elastomer made from ethylene-propylene diene monomer, polyionomers such as Surlyn®, polyphenylene oxide, polyphenylene sulfide, polysulfone, polyethersulfone, polystyrene, polyvinylidene chloride or fluoride, polyaryl ethers, polyaryl sulfones, polybutadienes, polysulfones, polyether sulfones, polyphenylene sulfides, polyvinyl acetate, polysiloxanes polyacrylates, polyvinylacetals, amino resins, phenylene oxide resins, terephthalic acid resins, epoxy resins, phenolic resins, polystyrene, polystyrene acrylonitrile copolymers, polyvinyl chloride, vinyl chloride and vinyl acetate copolymers, acrylate copolymers, alkyd resins, cellulosic film formers, styrene-butadiene copolymers, vinylidenechloride-vinylchloride copolymers, vinylacetate-vinylidenechloride copolymers, styrene-alkyl resins and the like as disclosed in U.S. Pat. No. 4,515,882, the disclosure of which is totally incorporated by reference, and the like, and mixtures thereof. The insulating material may be any suitable thermosetting or thermoplastic composition. Polyesters include Vitel PE-100 and PE-200 available from Goodyear Tire and Rubber Company. Epoxy resins include Araldite 6010, 6008, 6028 available from Ciba-Geigy Corporation. The insulating material may be comprised of the resins disclosed herein, such as a polyamide-imide, polyester, or epoxy, which may be present in any effective amount, and preferably in an amount ranging from about 30 to 100% by weight of the insulating material after curing. The filler may be any nonconductive material such as mica, talc, $TiO_2$, $BaTiO_3$, ZnO, $Ba(SO_4)_2$, $Al_2O_3$ in the amount of about 70% to 0% by weight. In the embodiment wherein a metal core is selected, the layer of insulating material may be of any effective thickness, preferably ranging from about 10 to about 250 microns, and more preferably from about 15 to about 150 microns. The insulating material may be coated on the metal core by any suitable technique including spray coating, flow coating, powder coating, and dip coating.

In embodiments wherein a completely dielectric core is selected, the core material may be an extruded tube or solid rod. The void region inside the dielectric tube material may be optionally filled with any suitable composition including rigid polyurethane foam available from Isofoam Systems, Inc. The foam may have a density of for example from about 4 to about 25 lbs/cu ft and preferably from about 8 to about 16 lbs/cu ft. The foam may serve to reinforce the tube for mechanical properties and to dampen vibrations which may occur during preparation of the electrode structure on the surface of the tube.

A layer of a photo or thermally sensitive composition is applied to the top surface of the insulating member by any suitable process. The layer can be of any effective thickness, and preferably from about 1 to about 6 microns thick. The composition can be applied to the substrate by a variety of means either in solution, dispersion or neat. When applied as a liquid, either in solution, dispersion or neat, the method of application can be, for example, rod or knife drawdowns, nip roll coating, reverse roll coating, three roll coating, two roll dip coating, knife coating, solution dipping, flow coating, spray coating, spinning or the like. Other methods of applications such as laminating, calendering and extrusion are possible with heat flowable compositions. When applied as dry resin, such as a powder, the application methods can include spraying, sputtering or dusting or the like. If the composition is applied in solution, dispersion or any non-neat liquid, a 100% reactive film can be formed by evaporating solvent with heat or infrared. If it is applied neat, it can be imaged directly or, if desired and necessary, converted (cured) to a dry film by exposure to heat or actinic radiation (of different wavelength than that utilized to form a pattern). It is preferable to utilize a curable 100% reactive resin composition which is curable at room temperature by radiation such as ultraviolet radiation, electron beam, x-ray or the like so that curing can be effected without adversely thermally degrading a wide variety of substrates, and organic solvent evaporation is not an environmental problem.

The photosensitive composition comprises a photosensitive polymeric material, especially those which either crosslinks or degrades in response to light. Conventional photoresists may be employed in embodiments. Both thermosetting and thermoplastic polymeric materials can be utilized. The photosensitive composition may comprise one or more components in any effective amounts, and preferably contains photosensitive polymeric material in an amount of from about 50% to 100% by weight of the photosensitive composition after curing. Representative examples of thermosetting polymeric materials are epoxies and urea- or phenol-formaldehyde based resins such as those disclosed in Robert W. Martin, "The Chemistry of Phenolic Resins, John Wiley & Sons (1956); Erdmann, U.S. Pat. No. 3,295,974; Toukhy, U.S. Pat. No. 4,529,682; and Shankoff and Trozzolo, "On the Spectral Sensitization of Negative and Positive Photoresists," Photographic Science and Engineering, Vol. 19, No. 3, pp. 173–175 (May/June 1975), the disclosures of which are totally incorporated by reference. Representative examples of thermoplastic polymeric materials are acrylic, urethane, amide, imide, and siloxane based resins. Any combination of the representative polymers in polyblends, copolymers or other composites are suitable. Typical reactive resin compositions for radiation induced free radical polymerization for negative acting resists are composed of photoinitiators; photoreactive prepolymers, such as acrylated urethanes; monomers such as pentaerythritol triacrylate and solvents, such as methyl ethyl ketone ("MEK"), diglyme, N-methyl pyrrolidone. Typical reactive resin compositions for radiation induced ionic polymerizations for negative acting resins are composed of photoinitiators; di- or multi-functional epoxies, such as the diglycidyl ether of Bisphenol A; and in some cases, multifunctional compounds such as diacids, diols and anhydrides. Typical reactive compositions for a photosensitive positive acting polymeric materials are composed of novolak resins, orthoquinone diazides, solvents, such as ethylene glycol monomethyl ether or butylacetate. A suitable negative acting photosensitive polymeric material such as partially cyclized isoprene, a bis-arylazide sensitizer in a xylene solvent, is available as KT 1747 from Olin-Ciba-Geigy. In preferred embodiments, the polymeric material of the photosensitive composition is hydroxyethylcellulose available as Natrosol 250MHR and Natrosol 250LR (which is of a lower molecular weight and which is more readily water soluble) from the Aqualon Company.

The thermally sensitive composition comprises a thermally sensitive polymeric material, especially those which crosslinks in response to heat. In embodiments, the thermally sensitive composition may comprise any suitable thermally sensitive polymeric material which can be vaporized by a laser including the polymers disclosed in Robert W. Lenz, "Organic Chemistry of Synthetic High Polymers," Interscience Publishers, a division of John Wiley & Sons, pp. 733–759 (1967), the disclosure of which is totally incorporated by reference. The thermally sensitive composition may comprise one or more components in any effective amounts, and preferably contains thermally sensitive polymeric material in an amount of from about 50% to 100% by weight. Representative examples of thermally sensitive polymeric materials containing anhydrides include water and/or aqueous-alkaline soluble maleic anhydride containing copolymers such as copolymers of maleic anhydride with N-vinylpyrrolidone, 2-hydroxyethyl acrylate, vinylsulfonic acid, p-styrenesulfonic acid, acrylamido-N-methyl-N-propane-3-sulfonic acid, acrylic acid and methacrylic acid or terpolymers containing any two of the above monomers with maleic anhydride; and water soluble itaconic anhydride containing copolymers with the same above monomers. Also copolymers of vinyl acetate and either of the above anhydrides could be hydrolyzed in alkali to give directly the alkali or water soluble copolymer of the ring opened anhydride and vinyl alcohol. In addition to the above water and/or alkaline soluble thermally sensitive anhydride containing polymers, other suitable thermally sensitive anhydride containing polymers soluble in aqueous alkali, as a result of anhydride ring opening by water, and in organic solvents such as MEK, include maleic and itaconic anhydride copolymers with the following comonomers: styrene, butadiene, t-butylstyrene, alpha methylstyrene, vinylnaphthalene vinyl-alkyl ether monomers such as vinyl methyl ether and the like, alpha olefins such as ethylene to $C_{18}$ alpha olefins, acrylic and methacrylic acid derivatives, vinyl chloride, acrolein, methyl and phenyl vinylketones, and vinylheterocyclic monomers such as N-vinylphthalimide, N-vinylsuccinimide, N-vinylcaprolactam and N-vinylcarbazole. The thermally sensitive copolymers from any of the above monomer combinations with maleic and itaconic anhydride contain pendent (to the polymer backbone) anhydride repeat units so hydrolytic ring opening by aqueous alkali to give aqueous solubility generally does not result in cleavage of the copolymer backbone. Since thermal cross-linking generally also proceeds without backbone cleavage, molecular weight buildup and resistance of the cross-linked areas to aqueous or non-aqueous development wash-away is excellent. On the other hand, thermally sensitive copolymers containing backbone (not pendent) anhydride groups are less preferred when aqueous or aqueous-alkaline development is involved because after thermal cross-linking and development in these solvents, these anhydride copolymers undergo backbone cleavage which give low molecular weight fragments that may wash-away during development, and therefore afford incomplete electrode configuraton. If organic solvent development were used instead of aqueous or aqueous alkaline development and the backbone anhydride copolymers were dissolved in an organic solvent to fabricate the thermally sensitive coating, then the backbone anhydride containing thermally sensitive copolymers could also be used to fabricate these thermally sensitive layers because backbone cleavage of the cross-linked copolymer generally would not occur during organic development. Suitable thermally sensitive copolymers containing backbone anhydride units include poly (oxycarbonyl-1,4-phenyleneoxytrimethyleneoxy-1,4-phenylenecarbonyl), poly(oxycarbonyl-1,4-phenylenetetramethylene-1,4-phenylenecarbonyl), poly (oxycarbonyl-1,4-phenyleneisopropylidene-1,4-phenylenecarbonyl), poly(oxycarbonylethyleneoxy-1,4-phenyleneisopropylidene-1,4-phenyleneoxyethylenecarbonyl), poly(oxycarbonyl-4-phthalimido-N-hexamethylene-N'-phthalimido-4-carbonyl), and poly(oxycarbonylethylene-2-furanyl-5-ethylenecarbonyl). When nonaqueous or nonaqueous-alkaline development is employed, the thermally sensitive anhydride containing copolymer is first coated from an organic solvent such as methyl ethyl ketone, which does not attack the preferred adhesive sub layer Vitel polyester PE-100, also now known as Vitel 1200, available from the Goodyear Tire and Rubber Co. Vitel 1200 and PE-100 are believed to have the same composition and are believed to comprise polyethylene terephthalate and polyethylene isophthalate.

In addition to the thermally sensitive anhydride copolymers described herein, water or alkaline soluble copolymers of methyl acrylamido glycolate methyl ether ("MAGME") described in the paragraph herein are optimum compositions for the thermally sensitive laser crosslinkable coatings of this invention. In embodiments, if Vitel PE-100 is employed as the adhesive sub-layer to coat the thermally sensitive layer thereon, one can use most organic coating solvents except for chlorinated solvents which also would attack the Vitel PE-100 adhesive sub-layer, thereby largely removing the adhesive and making good adhesion to the metal unlikely. To avoid this potential problem, one may, in embodiments, coat the thermally sensitive MAGME copolymer layer from either (1) lower alcohol solvents, such as methanol, ethanol, and isopropanol or a hydroxy ether such as Dowanol PM which is 1-methoxy-2-hydroxy propane available from DOW Chemical; or from (2) ketone solvents such as methyl ethyl ketone, methyl isobutyl ketone or cyclohexanone. There are numerous MAGME copolymer compositions soluble in lower alcohol solvents, especially methanol, that could be used. MAGME, available from American Cyanamid as MAGME 100 monomer, can be copolymerized with many other monomers to give copolymers suitable as thermally sensitive layers. Comonomers polymerizable with MAGME that give lower alcohol soluble copolymers include 2-hydroxyethyl methacrylate, 2-hydroxyethyl acrylate, 2-hydroxypropyl methacrylate, 2-hydroxypropyl acrylate, methyl methacrylate, butyl methacrylate, ethyl methacrylate, 2-ethylhexyl methacrylate and the four corresponding acrylates of the previous four methacrylates, vinyl acetate, N-vinylpyrrolidone, 2-and 4-vinylpyridine, acrylonitrile and methacrylanitrile, N,N-dimethlacrylamide, N,N-dimethylmethacrylamide, vinyl chloride, acrolein, methyl and phenylvinyl ketones, and vinyl heterocyclic monomers such as N-vinylcarbazole, N-vinylphthalimide, N-vinylsuccinimide, and N-vinylcaprolactam. Other comonomers polymerizable with MAGME that give methyl ethyl ketone soluble copolymers include styrene, t-butylstyrene, vinylnaphthalene, p-styrenesulfonic acid, methacrylic and acrylic acids, alpha olefins, conjugated dienes, and alkyl vinyl ether monomers. The thermally sensitive polymeric materials preferably is a poly(methyl vinyl ether/maleic anhydride) copolymer or a methyl acrylamido glycolate methyl ether copolymer, and is optimally a water soluble or alkaline soluble copolymer comprising MAGME and N-vinylpyrrolidone, 2-hydroxyethyl methacrylate or 2-hydroxyethyl acrylate.

Yuh et al., U.S. Pat. No. 5,063,125, the disclosure of which is totally incorporated by reference, discloses the cross-linking chemistry of the MAGME repeat unit upon exposure to heat with and without acid catalysis. Since the laser writing in embodiments of the present invention involves more heat than was used in U.S. Pat. No. 5,063,125 to make conductive layers in photoreceptors, the acid catalysis is not required at 150° C. or higher but could be optionally used. Para-toluene sulfonic acid is the preferred organic acid catalyst to cross-link MAGME containing polymers.

Each monomer component of the various copolymers employed in the radiation sensitive compositions may be present in any effective ratio. For example, in embodiments, MAGME may be present in the copolymer in a molar proportion ranging from about 0.1 to 100%, and preferably from about 25 to about 75%. Maleic anhydride and itaconic anhydride may be present in the same molar proportion as described herein. It is understood that when the monomer proportion reaches 100%, the polymer is a homopolymer.

A layer of the thermally sensitive polymeric materials may be applied to the top surface of the insulating member from a solution containing the thermally sensitive polymeric material and any suitable solvent. Illustrative preferred solvents include water, tetrahydrofuran, Dowanol PM, methyl ethyl ketone, methanol, and the like, or mixtures thereof. The molar ratio of the thermally sensitive polymeric material to the solvent in the solution may be in any effective proportion, and preferably ranges from about 1/5 to about 1/1. In embodiments, the thermally sensitive polymeric materials typically comprise from about 5 to about 15% by weight of solids in the solution. The layer of the thermally sensitive polymeric material may be of any effective thickness, and preferably ranges from about 1 to about 4 microns in thickness (dry film).

In embodiments, the photo or thermally sensitive composition also contains a nucleating agent. When the composition is coated onto the insulating member, the nucleating agent is incorporated in the photo or thermal sensitive polymeric material in an effective amount. The amount of the nucleating agent in the coating preferably ranges from about 1 to about 15% by weight, and more preferably from about 5 to about 13% by weight. The photo or thermally sensitive composition may be prepared for example from a solution containing effective amounts of the following: a suitable solvent such as that described herein (preferably, in a concentration ranging from about 80 to about 98% by weight), a suitable polymeric material such as that described herein (preferably, in a concentration ranging from about 1.9 to about 19.9% by weight), and a suitable nucleating agent such as that described herein (preferably, in a concentration ranging from about 0.004 to about 0.062% by weight).

In preferred embodiments, the photosensitive composition also contains a crosslink promoter to enhance crosslinking of the polymeric material in response to light exposure. The promoter may be any suitable dye such as 4,4'-dilhydroxyazobenzene-3,3'dicarboxylic acid disodium salt available as Aldrich dye 32680-1; 4,4'-azobis(4-cyano valeric acid) available as Aldrich dye 11816-8; 1,1'-azobis (N,N-dimethyl formamide) available as Aldrich dye 19315-1; azomethine-H available as Aldrich dye 28519-6, mixtures thereof, and the like. When the composition is coated onto the insulating member, the promoter is incorporated in the photosensitive polymeric material in an effective amount, preferably ranging from about 0.00145 to about 0.0725% by weight, and more preferably ranging from about 0.00725 to about 0.0435% by weight.

In preferred embodiments, the thermally sensitive composition also contains a crosslink promoter to enhance crosslinking of the polymeric material in response to thermal radiation. The promoter may be any effective compound such as an acid, particularly an organic acid. A preferred acid promoter is p-toulene sulfonic acid. When the composition is coated onto the insulating member, the promoter is incorporated in the thermally sensitive polymeric material in an effective amount, preferably ranging from about 0.00145% to about 3% by weight, and more preferably ranging from about 1 to about 0.0725% by weight.

In embodiments of the present invention, the photo and thermally sensitive polymeric material and the nucleating agent are soluble in any suitable aqueous based solvent or alcohol. The phrase "aqueous based solvent" or "water soluble" includes water and dilute acids and bases. The term dilute refers to acidic or basic solutions containing at least about 90% by weight of water, solutions such as 1% sodium hydroxide, 3% sodium carbonate, and 5% sodium chloride, and the like. Representative alcohols include lower alcohols such as methanol, ethanol, isopropanol, mixtures thereof, and the like. Aqueous or alcohol solubility of the photo and thermally sensitive compositions is advantageous in their removal since there is reduced need for the use of more toxic organic solvents to effect removal, thereby reducing possibly toxic emissions.

The nucleating agent may be any suitable metal salt or metal cation, wherein the metal includes nickel, tin, copper, cobalt, iron, noble metal, a salt thereof, or mixtures thereof. Noble metal cations include gold, silver, platinum, palladium, iridium, rhenium, ruthenium, or osmium, and the like. Suitable counterions to the noble metal cations include acetate and halogens such as chloride and bromide, and the like.

The nucleating agent may not be compatible with certain polymeric materials, i.e., the nucleating agent may precipitate out or be rendered insoluble. In preferred embodiments where the radiation sensitive composition is water soluble, the nucleating agent is a palladium salt such as palladium chloride or pallidium acetate, and the polymeric material is a hydroxyethylcellulose, a poly(methyl vinyl ether/maleic anhydride) copolymer, or a methyl acrylamido glycolate methyl ether copolymer such as a copolymer comprising a methyl acrylamido glycolate methyl ether and N-vinylpyrrolidone, 2-hydroxyethyl methacrylate or 2-hydroxyethyl acrylate.

The photo or thermally sensitive composition may be patterned into a first portion corresponding to the electrode pattern and a second portion corresponding to the remainder of the radiation sensitive composition by exposure to any suitable light or heat source. Any suitable technique may be used including patterning by ultraviolet radiation through a line pattern mask, or patterning directly with an electron beam, or a laser. The conventional light source or laser useful for patterning the photo or thermally sensitive composition may be of any effective wavelength or range of wavelengths including visible light, infrared light, ultraviolet light, x-ray, and the like. Preferably, the light source for photosensitive compositions has a wavelength of from about 200 to about 1000 nm, and more preferably from about 300 to about 500 nm. The patterning of photoresist by exposure to light is illustrated, for example, in Lake et al., U.S. Pat. No. 4,915,983, the disclosure of which is totally incorporated by reference. The light source for thermally sensitive compositions is preferably a Yttrium-Aluminum-Garnet ("YAG") laser (1064 nm) or a $CO_2$ laser (10.6 microns) with a laser power ranging from about 0.1 to about 3 Watts for a spot size of 100 microns and scan speeds of about 0.1 to about 0.4 inches per seconds.

The conductive metal may be deposited in an effective amount by any suitable technique including electroless deposition and/or electroplating as illustrated, for example, in U.S. Pat. Nos. 4,666,735 and 3,632,435, the disclosures of which are totally incorporated by reference. Representative conductive metals include tin, aluminum, iron, steel, nickel, copper, gold, silver, platinum, palladium, and the like. Conventional electroless metal deposition solutions and conditions may be employed. A preferred electroless nickel deposition solution is Niklad 797, which is available from Allied-Kelite, a division of Witco Company. Niklad 797 comprises Niklad 797A, Niklad 797B and water (distilled or deionized), wherein the preferred component ratio is 5% 797A, 15% 797B and 80% water by volume. Metal deposition times may be of any effective duration, preferably ranging from about 30 seconds to about 2 hours. The solution temperature for Niklad 797 ranges from about 185 to about 195° F. It is understood that the operating conditions may be outside the values expressly described herein, but nevertheless are encompassed by the present invention.

After patterning of the radiation sensitive composition, and before or after deposition of the conductive metal, the portion of the photo or thermally sensitive composition corresponding to the non-electrode pattern area is preferably completely removed. The portion removed may either be the exposed or unexposed portion, depending on whether the polymeric material of the photo or thermally sensitive composition is of a positive or negative type, i.e., whether the polymeric material degrades or crosslinks in response to exposure to light or heat. Degradation and crosslinking change the solubility of the exposed portion of the radiation sensitive composition, thereby permitting selective removal. The term "degradation" for thermally sensitive compositions includes their vaporization by a laser. In a preferred embodiment, the exposed portion of the radiation sensitive composition is removed.

The exposed and unexposed portions of the radiation sensitive composition may be removed by any known technique including removal using an aqueous base solution, aromatic hydrocarbons, alcohols, esters, or ethers, and the like, and mixtures thereof, depending upon the chemical make-up of the radiation sensitive composition. A developer which removes the polymeric material of the radiation sensitive composition will typically also wash away the nucleating agent and/or crosslinking promoters. Removers are available, for example, from the Shipley Company including Microposit MF-319 (comprised of tetramethyl ammonium hydroxide) and Microposit 1165 (comprised of N-methyl pyrrolidone). This process referred to herein as development can be accomplished by a number of known methods such as spraying, dipping, puddle processing, or the like. The solvents, as described herein, which comprise a component of the solutions used to prepare the photo and thermally sensitive compositions, may also be employed to remove the exposed and unexposed portions of the radiation sensitive composition.

In certain embodiments of the present invention, the insulating member is comprised of an insulating polymeric material and a nucleating agent. The nucleating agent may be present in an effective amount in the insulating polymeric material. The nucleating agent preferably may be present in an amount ranging from about 1 to about 15% by weight, and more preferably from about 5 to about 13% by weight. The insulating material may be prepared from a solution comprising an insulating polymeric material, a nucleating agent and a solvent, wherein each component may be a component as described herein. The insulating material may be prepared for example from a solution containing effective amounts of the following: a suitable solvent (preferably, in a concentration ranging from about 8 to about 98% by weight), an insulating polymeric material (preferably, in a concentration ranging from about 1.9 to about 19.9% by weight), and a nucleating agent (preferably, in a concentration ranging from about 0.004 to about 0.062% by weight). In embodiments, the nucleating agent is molecularly dispersed in the insulating polymeric material, typically as submicron particles dispersed therein. The insulating member containing the nucleating agent is then coated by a radiation sensitive composition using any of the polymeric materials described herein or any conventional positive or negative acting photo or thermal resist. The radiation sensitive composition is subsequently patterned as described herein into a first portion corresponding to the electrode pattern and a second portion corresponding to the non-electrode pattern area. The portion of the radiation sensitive composition corresponding to the electrode pattern is removed by any suitable method including the methods described herein to expose a portion of the surface of the insulating member. Conductive metal is then deposited by methods described herein on the exposed portion of the insulating member where the first portion has been removed. The remaining radiation sensitive resist may then be removed by the methods described herein or by any known conventional methods.

In preferred embodiments, the surface of the insulating member is pretreated to improve adhesion and/or to provide a uniform metal coating by treatment with plasma or corona discharge to increase critical surface tension, preferably up to about 40 dynes/cm. Corona discharge treatment is illustrated in U.S. Pat. No. 4,666,735(reference for example col. 6), the disclosure of which is totally incorporated by reference. Corona discharge may be applied to the surface of the donor roll at an effective stage during the fabrication of the electroded donor. For example, corona discharge may be applied to the donor roll surface before or after coating the surface of the insulating member with the radiation sensitive composition, or after removal of a portion of the radiation sensitive composition. Any suitable equipment may be used to treat surfaces with corona discharge including Enercon Model A1 corona surface treater available from Enercon Industries Corporation.

In preferred embodiments, after the conductive metal is deposited on the donor roll, additional amounts of the same or different conductive metal is either electrolessly deposited or electroplated on the electrode pattern to increase the line thickness to any effective thickness. The term thickness refers to the depth or height of the electrode lines. For example, to build up a nickel electrode pattern having a line thickness of from about 0.2 to about 2 microns, formed by electroless deposition, additional nickel may be electroplated onto the electrode pattern to increase the line thickness to about 2.5 to about 10 microns. As another example, to build up the line thickness of a nickel electrode pattern formed by electroless deposition, copper may be deposited by electroless deposition onto the electrode pattern. Deposition of additional layers of metal is illustrated in U.S. Pat. Nos. 4,666,735 (reference for example col. 9) and 3,632,435 (reference for example col. 11).

After conductive metal is deposited to form the electrode pattern, the surface of the donor roll is coated with a semi-conductive polymeric material to cover at least the electrode pattern, preferably the entire surface of the roll, for electrical isolation and wear protection for the electrode lines. The semi-conductive polymeric material may be of any suitable composition. For example, the semi-conductive material may be comprised of: (1) a charge transport material such as a phenyldiamine as illustrated in Stolka et al., U.S. Pat. No. 4,265,990, the disclosure of which is totally incorporated by reference; (2) a binder polymer such as polycarbonate; and (3) a charge injecting material which can be carbon in its various forms, metal particles and their oxides and inorganic materials such as metal halides including ferric chloride. Representative charge transport materials, binder polymers, and charge injecting enabling materials are illustrated in Mammino et al., U.S. Pat. No. 4,515,882, the disclosure of which is totally incorporated by reference. The semi-conductive polymeric material may be applied to the surface of the donor roll by any suitable technique including dip coating and spray coating.

The electrode pattern may be of any effective design which permits the lines of the pattern to be electrically biased to detach toner from the donor roll to form a cloud of toner for development of a latent image with toner. In embodiments, the electrode pattern is comprised of a plurality of spaced lines, parallel to the long axis of the donor roll, arranged about the peripheral circumferential surface of the donor roll. Preferably, the length of each electrode line is at least about half, more preferably from about ¾ to nearly the full length of the donor roll. In embodiments, the lines of the electrode pattern are of any effective width, preferably ranging from about 50 microns to about 150 microns, and more preferably about 100 microns. In embodiments, the lines of the electrode pattern are of any effective depth, preferably ranging from about 0.5 to about 10 microns, and more preferably from about 1.5 to about 5 microns in depth. The lines are spaced apart at effective intervals, preferably ranging from about 100 microns to about 200 microns, and more preferably about 150 microns.

Referring now to the FIGURE, there is shown a representative developer unit 38. As shown thereat, developer unit 38 includes a housing 44 defining a chamber 76 for storing a supply of developer material therein. Donor roll 40 is comprised of conductive metal core 74, dielectric layer 80, electrical conductors 42 positioned about the peripheral circumferential surface of the roll, and semi-conductive layer 120. The electrical conductors are substantially equally spaced from one another and insulated from the body of donor roll 40 which is electrically conductive. Donor roll 40 rotates in the direction of arrow 68. A magnetic roller 46 is also mounted in chamber 76 of developer housing 44.

Magnetic roller 46 is shown rotating in the direction of arrow 92. An alternating voltage source 100 and a constant voltage source 102 electrically bias donor roll 40 in the toner loading zone. Magnetic roller 46 Is electrically biased by AC voltage source 104 and DC voltage source 106. Normally both of these voltages are set to zero. The relative voltages between donor roll 40 and magnetic roller 46 are selected to provide efficient loading of toner on donor roll 40 from the carrier granules adhering to magnetic roller 46. Furthermore, reloading of developer material on magnetic roller 46 is also enhanced. In the development zone, voltage sources 108 and 110 electrically bias electrical conductors 42 to a DC voltage having an AC voltage superimposed thereon. Voltage sources 108 and 110 are in wiping contact with isolated electrodes 42 in development zone. As donor roll 40 rotates in the direction of arrow 68, successive electrodes 42 advance into the development zone 112 and are electrically biased by voltage sources 108 and 110. As shown in the FIGURE, wiping brush 113 contacts isolated electrodes 42 in development zone 112 and is electrically connected to voltage sources 108 and 110. In this way, isolated electrodes or electrical conductors 42 advance into development zone 112 as donor roll 40 rotates in the direction of arrow 68. Isolated electrodes, i.e. electrical conductors 42, in development zone 112, contact wiping brush 113 and are electrically biased by voltage sources 110 and 108. In this way, an AC voltage difference is applied between the isolated electrical conductors and the donor roll detaching toner from the donor roll and forming a toner powder cloud. Voltage 108 can be set at an optimum bias that will depend upon the toner charge, but usually the voltage is set at zero. The electroded donor roll assembly is biased by voltage sources 114 and 116. DC voltage source 116 controls the DC electric field between the assembly and electrostatic latent image surface 10 (moving in direction 16) for the purpose of suppressing background deposition of toner particles. AC voltage source 98 applies a AC voltage on the core of donor roll 40 for the purpose of applying an AC electric field between the core of the donor roll and conductors 42, as well as between the donor roll and latent image surface 10. Although either of the AC voltages 98 and 110 could be zero, other voltages must be non-zero so that a toner cloud can be formed in the development zone. For a particular toner and gap in the development zone between the donor roll and electrostatic latent image surface, the amplitude and frequency of the AC voltage being applied on donor roll 40 by AC voltage supply 114 can be selected to position the toner powder cloud in close proximity to the electrostatic latent image surface of belt 10, thereby enabling development of an electrostatic latent image consisting of fine lines and dots. It should also be noted that a wiping brush 96 engages donor roll 40 in loading zone 94. This insures that the donor roll is appropriately electrically biased relative to the electrical bias applied to the magnetic roller 46 in loading zone 94 so as to attract toner particles from the carrier granules on the surface of magnetic roller 46. Magnetic roller 46 advances a constant quantity of toner having a substantially constant charge onto donor roll 40. This insures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a non-magnetic tubular member 86 made preferably from aluminum and having the exterior circumferential surface thereof roughened. An elongated magnetic 84 is positioned interiorly of and spaced from the tubular member. The magnet is mounted stationarily. The tubular member rotates in the direction of arrow 92 to advance the developer material adhering thereto into a loading zone 94. In loading zone 94, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in the direction substantially parallel to the longitudinal axis of the shaft.

In embodiments, the donor roll may be of a scavengeless electrode development (SED) configuration such as illustrated in the FIGURE herein where the electrical potential for the toner cloud generation is applied between the electrodes and the conductive and dielectrically coated metal roll substrate. In embodiments, the donor roll may be alternatively of a scavengeless interdigitated development (SID) configuration such as that illustrated in copending application, U.S. Ser. No. 07/724,242, filed Jul. 1, 1991 (Attorney Docket No. D/86305Q), now abandoned, the disclosure of which is totally incorporated by reference. In SID configured donor rolls, the electrical potential is applied between adjacent electrodes which are interdigitated for individual electrical connection and supported on a thick dielectric coated metal roll substrate or completely dielectric roll material. The completely dielectric roll material may be an extruded tube or solid rod which is provided with end shafts for mounting in the developer application.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A layer of Torlon AI-10 polyamide-imide polymer was applied onto a 3×3 inches aluminum plate by spray coating from a solution comprised of 200 g (grams) of the polyamide-imide polymer in 500 g of N-methyl pyrrolidone solvent with 150 g of T-8598 solvent (contains diacetone alcohol, 1-methoxy 2-propanol acetate, and aromatic hydrocarbon) available from the DuPont Corportion and 3 g of SR-112 silicone resin solution (containing about 30–60% by weight xylene, 25 parts per million benzene, 10–30% by weight ethylbenzene, and 30–60% by weight dimethylphenylsiloxane resin) from the General Electric Co. The coated plate was dried at about 140° C. and cured at 205° C. for 30 min. to render the polyamide-imide polymer insoluble in organic solvents. The film thickness was about 10 microns. The photocrosslinkable layer was applied onto this polyamide-imide layer from a solution of 10 g of a solution of 5 g of Natrosol 250MHR in 500 g of water, with 10 g of additional water, 0.002 g of the azo dye 4,4'-dihydroxyazobenzene-3,3' dicarboxylic acid disodium salt, and 0.5 g of a 5% by weight solution of palladium chloride in water with 10% by weight of hydrochloric acid. This solution was flow coated onto the aluminum plate which had the polyamide-imide coating. The coated plate was dried at 105° C. for 30 minutes. The plate was photosensitive to ultraviolet light (about 380 to about 400 nm) when exposed through a line pattern mask and gave a line pattern of the Natrosol 250MHR polymer with palladium chloride layer after removal of the unexposed Natrosol polymer by washing the plate with water. The plate was placed in an electroless nickel bath comprised of 50 mL of Niklad 797A nickel salt, 150 mL of Niklad 797B complexor/buffer and 800 mL of deionized water. The electroless nickel solution was heated to 190° F. The nickel metal deposited after about 10 seconds and deposition continued for an additional 2 minutes. Nickel metal deposited onto the Natrosol polymer line pattern areas which contained the palladium chloride nucleating agent forming the electrodes.

EXAMPLE 2

A layer of Torlon AI-10 polyamide-imide polymer was applied onto a 3×3 inches aluminum plate by spray coating from a solution comprised of 200 g of the polyamide-imide polymer in 500 g of N-methyl pyrrolidone solvent with 150 g of T-8598 solvent from the DuPont Corportion and 3 g of SR-112 silicone resin solution from the General Electric Co. The coated plate was dried of the solvent at about 140° C. and cured at 205° C. for 30 min. to render the polyamide-imide polymer insoluble in organic solvents. The film thickness was from about 7 to about 12 microns. The thermally sensitive coating which is to be laser imaged was applied by spin coating onto the polyamide-imide coated aluminum plate from a 1 g solution comprised of 8 gms of Gantrez AN-119 (methyl vinyl ether/maleic anhydride copolymer) available from GAF Chemicals Corporation in 40 g of acetonitrile solvent with 0.02 g of palladium(II) acetate, available from Aldrich Chemical Co. Inc. 20,586-9. The thermally sensitive coating was dried at 60° C. for one hour and 85° C. for 20 minutes. The composition of the coating solution was about 9 percent weight solids and the weight percent of palladium in the coating was about 5.2. The coated plate was laser imaged with a line pattern using a $CO_2$ laser (10.6 microns) at 300 W/cm$^2$, forming 50 lines which were about 0.020 inch apart. This thermally crosslinked and insolubilized the Gantrez AN-119 coating which contained the palladium acetate. The unexposed and soluble Gantrez AN-119 polymer was removed by washing with a 1.0 percent weight sodium hydroxide solution for about 2 minutes. The imaged plate was then placed into an electroless nickel solution comprised of 50 mL of Niklad 797A nickel salt, 150 mL of Niklad 797B complexor/buffer and 800 mL of deionized water. The electroless nickel solution was heated to 190° F. The nickel metal deposited after about 10 seconds and deposition continued for an additional 2 minutes. The nickel metal deposited onto the line pattern image of Gantrez polymer which contained the palladium acetate electroless nucleating agent. The deposited nickel metal formed conductive electrodes on the surface of the polyamide-imide coated plate. The electrodes had a width of about 4 mil, spacing of about 6 mil, and a depth believed to be about 0.033 mil.

EXAMPLE 3

A radiation sensitive coating solution was prepared as follows. Five grams of a 10 weight percent solution of a copolymer of methylacrylamido glycolate methyl ether and N-vinylpyrrolidone at a 1 to 2 mole ratio in ethanol was prepared. To the above solution was added 4 g of an about 1 to about 6 weight percent solution of stannous chloride in ethanol, the solution stirred and then 5 g of a 1 weight percent solution of palladium acetate in acetone was added, thereby resulting in the coating solution. The coating solution was stirred and flow coated onto a glass slide (3 inches×4 inches) to a thickness of about 2 microns and dried in air, then in a forced air oven at 60° C. for 1 hour. A one inch outside diameter metal washer was heated on a hot plate to 170° C. and placed on the coated side of the glass slide for about 5 minutes. The metal washer was removed, the coating allowed to cool and then the glass slide was rinsed in deionized water for 10 minutes to remove the nonheated and noncrosslinked coating. The coating remaining on the glass slide was air dried for 5 minutes and dried for 1 hour in an oven at 100° C. and then the slide was placed into an electroless nickel solution having the same composition and under the same conditions described in Example 2. Nickel deposited on the glass plate in those areas conforming to the heated metal washer pattern only, not in the background area. This illustrates that the thermally sensitive coating may be crosslinked by heat and that the crosslinked area may be employed to initiate nickel metal electroless deposition to form conductive patterns. After 5 minutes of nickel deposition on the coated crosslinked area of the glass plate, the nickel coated area began to lift off the glass plate indicating poor adhesion of the copolymer coating on the glass in the hot (190° F.) nickel electroless deposition solution.

EXAMPLE 4

A radiation sensitive coating solution was prepared by repeating the processes of Example 3. The coating solution was spin coated onto the surface of 3 inches×3 inches aluminum plate which was previously coated with a polyester dielectric layer identified as Vitel PE-100 from Goodyear Tire and Rubber Company. The PE-100 coating was about 25 microns thick and the overcoating layer was about 1.5 microns thick. The coated plate was laser imaged with a line pattern using the same procedure described in Example 2. The laser imaged coating was washed in deionized water to remove the unexposed and soluble portion of the coating and dried using the same procedures described in Example 3. Immersion of the laser imaged, washed and dried coated aluminum plate in an electroless nickel solution resulted in nickel metal deposition on the laser crosslinked image areas. Nickel deposition occurred in a nickel solution having the same composition and under the same conditions described in Example 2. Prior to immersion in the nickel solution, all exposed aluminum metal areas of the plate were coated with an about 50 microns thick layer of a cellulose based polymeric resist, available as MicroShield from the 3M Corporation, to prevent contamination of the nickel solution by aluminum. Nickel metal deposition proceeded for about 15 minutes with no evidence of any metallized image line area lifting off of the PE-100 insulating coating indicating good adhesion of the metalized crosslinked copolymer of methylacrylamido glycolate methyl ether and N-vinylpyrrolidone. The metal deposition was uniform with a well defined line structure and a metal depth of about 2.5 microns.

EXAMPLE 5

A radiation sensitive coating solution was prepared by repeating the processes of Example 3 except that a copolymer of methylacrylamido glycolate methyl ether and hydroxyethylacrylate at a 1:1 mole ratio was used in place of the copolymer of methylacrylamido glycolate methyl ether and N-vinylpyrrolidone. The coating solution was spin coated onto the surface of a 3 inches×3 inches aluminum plate which was previously coated with a polyester dielectric layer identified as Vitel PE-100. The PE-100 coating was about 25 microns thick and the dried, spin coated over-layer was about 2 microns thick. A laser image pattern was generated using the same procedures described in Example 2, which resulted in crosslinking of the spin coated layer. The unexposed portion of the radiation sensitive composition was removed by washing the plate in deionized water at 140° F. for 30 minutes. The coating was dried using the same procedures described in Example 3, the exposed aluminum metal covered with an about 50 microns thick layer of a cellulose based polymeric resist, available as MicroShield from the 3M Corporation, to prevent contamination of the electroless nickel solution and the plate placed into the nickel solution to metalize the laser imaged areas. The same nickel deposition solution and conditions were used as described in Example 2. Good nickel metal deposition occurs after about 1 minute immersion in the nickel electroless solution. Metal adhesion to the crosslinked copolymer layer was excellent as was the adhesion of the crosslinked copolymer layer to the Vitel polyester insulating layer. Resistivity of the metallized line area was less than 1000 ohms.

EXAMPLE 6

A radiation sensitive coating solution was prepared by repeating the processes of Example 3 except that 2 g of a titanium dioxide pigment was predispersed in the MAGME and N-vinyl pyrrolidone copolymer prior to the addition of the stannous chloride and palladium acetate. The coating solution was spin coated onto the surface of a 3 inches×3 inches aluminum plate which was previously coated with a polyester dielectric layer identified as Vitel PE-100. The PE-100 coating was about 25 microns thick and the dried, radiation sensitive coating was about 2 to about 5 microns thick. The plate was laser imaged to create a line pattern using the same procedures described in Example 2. The plate was washed in deionized water to remove the noncrosslinked areas of the coating and dried using the same procedures described in Example 3 except that the washing time was extended to about 20 minutes. The same nickel plating solution and conditions were used as described in Example 2. Nickel metalization of the laser imaged areas remaining on the plate was excellent, line definition was good and adhesion of the metalized, crosslinked, radiation sensitive layer to the Vitel polyester layer was satisfactory.

EXAMPLE 7

A radiation sensitive coating solution was prepared by repeating the processes of Example 5 except that a copolymer of methylacrylamido glycolate methyl ether and hydroxyethylmethacrylate at a 2:1 mole ratio was used. The coating solution was spin coated onto the surface of a 3 inches×3 inches aluminum plate which was previously coated with a polyester dielectric layer identified as Vitel PE-100. The PE-100 coating was about 25 microns thick and the dried, radiation sensitive coating was about 2 to about 5 microns thick. The plate was laser imaged to create a line pattern using the same procedures described in Example 2. The laser exposed plate was placed into a tray of methanol for about 10 minutes to dissolve away the noncrosslinked portion of the radiation sensitive layer. The plate was dried using the same procedures described in Example 3 and placed into an electroless nickel solution. The same nickel plating solution and conditions were used as described in Example 2. Nickel deposition occurred on the laser imaged area with some deposition of nickel in the background areas as well.

EXAMPLE 8

The procedures as described in Example 7 were repeated, except that the laser exposed plate was washed for 20 minutes with Dowanol PM available from Dow Chemical Company and then rinsed in clear Dowanol PM to dissolve the noncrosslinked portion of the radiation sensitive layer. Good metal deposition was obtained in the laser imaged area with clean background areas indicating complete removal of the non-laser exposed portion of the radiation sensitive layer.

Other modifications of the present invention may occur to those skilled in the art based upon a reading of the present disclosure and these modifications are intended to be included within the scope of the present invention.

We claim:

1. A process for preparing a donor roll having an electrode pattern comprising:

(a) providing a cylindrically shaped insulating member;

(b) coating the insulating member with a photo or thermally sensitive composition comprised of a polymeric material and a conductive metal nucleating agent;

(c) patterning the composition, resulting in a first composition portion corresponding to the electrode pattern and a second composition portion; and (d) depositing conductive metal on the first composition portion, resulting in the electrode pattern which is capable of being electrically biased to enable detachment of toner particles from the donor roll.

2. The process of claim 1, further comprising removing the second composition portion.

3. The process of claim 1, further comprising: (e) coating the surface of the donor roll with a semi-conductive polymeric material.

4. The process of claim 1, wherein the nucleating agent is nickel, tin, copper, cobalt, iron, noble metal, a salt thereof, or mixtures thereof.

5. The process of claim 1, wherein the insulating member is coated with the photosensitive composition in step (b).

6. The process of claim 1, wherein the insulating member is coated with the thermally sensitive composition in step (b).

7. The process of claim 1, wherein the patterning of the composition is accomplished by exposing the first composition portion to a photo or thermal source.

8. The process of claim 1, wherein the electrode pattern corresponds to a plurality of spaced lines, parallel to the long axis of the donor roll, and arranged about the peripheral circumferential surface of the insulating member.

9. The process of claim 1, wherein the conductive metal is nickel or copper.

10. The process of claim 1, wherein the conductive metal is deposited by electroless deposition in step (d).

11. The process of claim 1, further comprising depositing a second conductive metal by electroless deposition onto the electrode pattern.

12. The process of claim 1, further comprising electroplating a second conductive material onto the electrode pattern.

13. The process of claim 1, further comprising applying corona discharge to the surface of the donor roll.

14. The process of claim 1, wherein the insulating member is comprised of a metal core and a layer of an insulating material.

15. The process of claim 14, wherein the layer of insulating material is a polyimide, polyamide-imide, polyester, polycarbonate, phenolic resin, epoxy resin, polyurethane, or polyamide.

16. The process of claim 1, wherein the patterning of the composition is accomplished by exposure to ultraviolet light or to a laser.

17. The process of claim 1, wherein the insulating member is comprised entirely of the insulating material.

18. The process of claim 1, wherein the insulating member is coated in step (b) with the photosensitive composition comprised of a polymeric material crosslinkable in response to light exposure, a promoter effective for enhancing the crosslinking of the polymeric material in response to light exposure, and the nucleating agent.

19. The process of claim 1, wherein the insulating member is coated in step (b) with a photosensitive composition comprised of hydroxyethylcellulose.

20. The process of claim 1, wherein the insulating member is coated in step (b) with the thermally sensitive composition comprised of a homopolymer or copolymer comprised of maleic anhydride or itaconic anhydride or a methyl acrylamido glycolate methyl ether homopolymer or copolymer.

21. The process of claim 1, wherein the insulating member is coated in step (b) with the thermally sensitive composition comprised of a copolymer comprising a methyl acrylamido glycolate methyl ether and N-vinylpyrrolidone, 2-hydroxyethyl methacrylate or 2-hydroxyethyl acrylate.

22. The process of claim 1, wherein the insulating member is coated in step (b) with the photo or thermally sensitive composition which is soluble in an aqueous based solvent or alcohol.

23. A process for preparing a donor roll having an electrode pattern comprising:

(a) providing a cylindrically shaped insulating member comprised of an insulating polymeric material and a conductive metal nucleating agent;

(b) coating the insulating member with a photo or thermally sensitive composition;

(c) patterning the composition, resulting in a first composition portion corresponding to the electrode pattern and a second composition portion;

(d) removing the first composition portion, thereby exposing a portion of the insulating member; and (e) depositing conductive metal on the portion of the insulating member where the first composition portion has been removed, resulting in the electrode pattern which is capable of being electrically biased to detach toner particles from the donor roll.

24. The process for preparing an apparatus for developing a latent image recorded on a surface, comprising:

(a) providing a housing with a chamber containing toner therein; and (b) providing a rotatable donor roll spaced from the surface and adapted to transport toner from the chamber of the housing to a development zone adjacent the surface, wherein the donor roll is prepared by the steps comprising:

(i) providing a cylindrically shaped insulating member;

(ii) coating the insulating member with a photo or thermally sensitive composition comprised of a polymeric material and a conductive metal nucleating agent;

(iii) patterning the composition, resulting in a first composition portion corresponding to the electrode pattern and a second composition portion; and (iv) depositing conductive metal on the first composition portion, resulting in the electrode pattern which is capable of being electrically biased to detach toner particles from the donor roll to form a cloud of toner particles in the space between donor roll and the surface with detached toner particles from the cloud of toner particles developing the latent image.

* * * * *